US008998002B1

(12) United States Patent
Milner

(10) Patent No.: US 8,998,002 B1
(45) Date of Patent: Apr. 7, 2015

(54) VERTICALLY ARRANGED HAIR EXTENSION RACK

(76) Inventor: Mandi B Milner, Crystal Lake, IL (US)

( * ) Notice: Subject to any disclaimer, the term of this patent is extended or adjusted under 35 U.S.C. 154(b) by 0 days.

(21) Appl. No.: 13/468,085

(22) Filed: May 10, 2012

(51) Int. Cl.
*A47F 7/00* (2006.01)
*A47F 7/06* (2006.01)

(52) U.S. Cl.
CPC ..... *A47F 7/065* (2013.01)

(58) Field of Classification Search
USPC ..... 211/13.1, 60.1, 61, 70, 70.6, 78, 85.3, 211/85.7, 96, 100, 101, 107, 133.4, 151, 211/163, 183, 196, 197, 205
See application file for complete search history.

(56) References Cited

U.S. PATENT DOCUMENTS

| | | | | | |
|---|---|---|---|---|---|
| 158,208 | A | | 12/1874 | Hall | |
| 785,196 | A | * | 3/1905 | Cannon | 211/190 |
| 853,762 | A | * | 5/1907 | Botsford | 211/205 |
| 1,038,198 | A | * | 9/1912 | Randall et al. | 211/205 |
| 1,089,290 | A | * | 3/1914 | Thompson | 248/165 |
| 1,221,517 | A | | 4/1917 | Dunbar | |
| 1,888,324 | A | | 11/1932 | Matthai | |
| 2,270,331 | A | | 4/1941 | Noble | |
| 2,903,227 | A | * | 9/1959 | De Kalb Key | 248/200.1 |
| 2,980,261 | A | * | 4/1961 | Young, Jr. | 108/30 |
| 3,018,898 | A | * | 1/1962 | Frazelle | 211/107 |
| 3,035,708 | A | * | 5/1962 | Freeman | 211/107 |
| 3,204,779 | A | * | 9/1965 | Warner | 211/190 |
| 3,612,287 | A | * | 10/1971 | Maltese | 52/298 |
| 3,739,919 | A | * | 6/1973 | Hochman | 248/220.43 |
| 3,771,665 | A | * | 11/1973 | Potter | 211/107 |
| 4,101,036 | A | * | 7/1978 | Craig | 211/107 |
| 4,380,296 | A | | 4/1983 | Murray et al. | |
| 4,446,973 | A | * | 5/1984 | Fuller et al. | 211/45 |
| 5,819,961 | A | | 10/1998 | Harris | |
| 6,705,468 | B1 | * | 3/2004 | Hall | 206/581 |
| 6,913,230 | B2 | | 7/2005 | Wells | |
| 6,938,766 | B1 | | 9/2005 | Lee | |
| 7,159,728 | B2 | * | 1/2007 | Smith | 211/166 |
| 7,775,377 | B2 | | 8/2010 | Abney | |
| 8,020,716 | B2 | * | 9/2011 | Vitale | 211/197 |
| 8,281,939 | B2 | * | 10/2012 | Chen | 211/13.1 |
| 2001/0019095 | A1 | | 9/2001 | Valiulis | |
| 2005/0194327 | A1 | * | 9/2005 | Chen | 211/13.1 |
| 2006/0180558 | A1 | * | 8/2006 | Engberg | 211/60.1 |
| 2006/0289368 | A1 | | 12/2006 | Abney | |
| 2007/0114191 | A1 | * | 5/2007 | Chen | 211/13.1 |
| 2009/0008347 | A1 | * | 1/2009 | Bell | 211/61 |
| 2012/0137534 | A1 | * | 6/2012 | Barnard | 34/72 |
| 2013/0104922 | A1 | | 5/2013 | Hall et al. | |

* cited by examiner

*Primary Examiner* — Joshua Rodden
(74) *Attorney, Agent, or Firm* — Patents and Licensing LLC; Daniel W Juffernbruch

(57) ABSTRACT

A rack for holding hair extensions. A vertical member has a plurality of openings arranged along a length of the vertical member. Combs hold the hair extensions. The combs attach in a series of vertically arranged openings along a length of the vertical member. The openings in the vertical member are arranged in a spiral or other pattern as desired for an organization of hair extensions according to where they go on a head and adapt to right or left handed users or different styles and kinds of extensions on one or more heads.

13 Claims, 8 Drawing Sheets

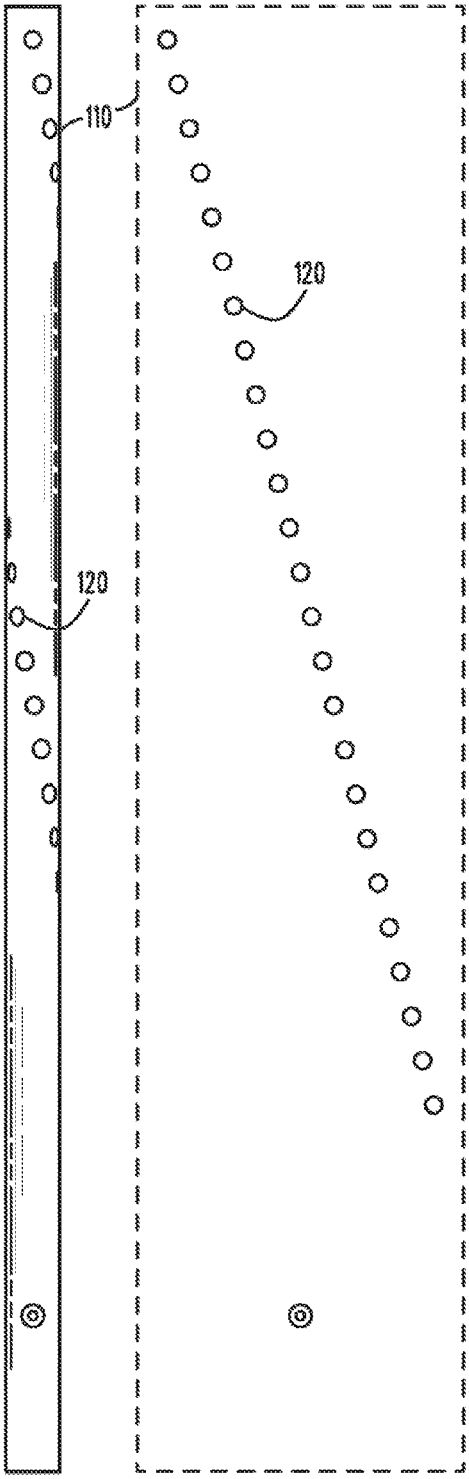
FIG. 6
FIG. 7
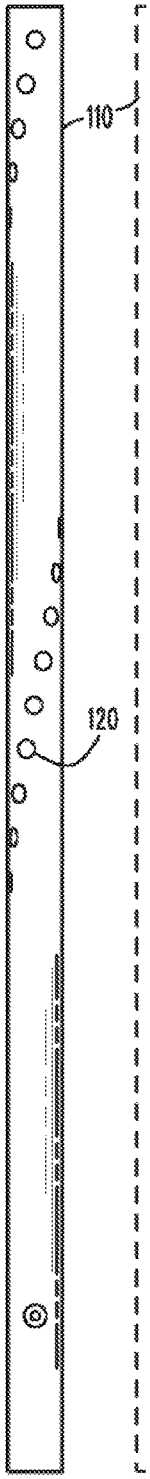
FIG. 8
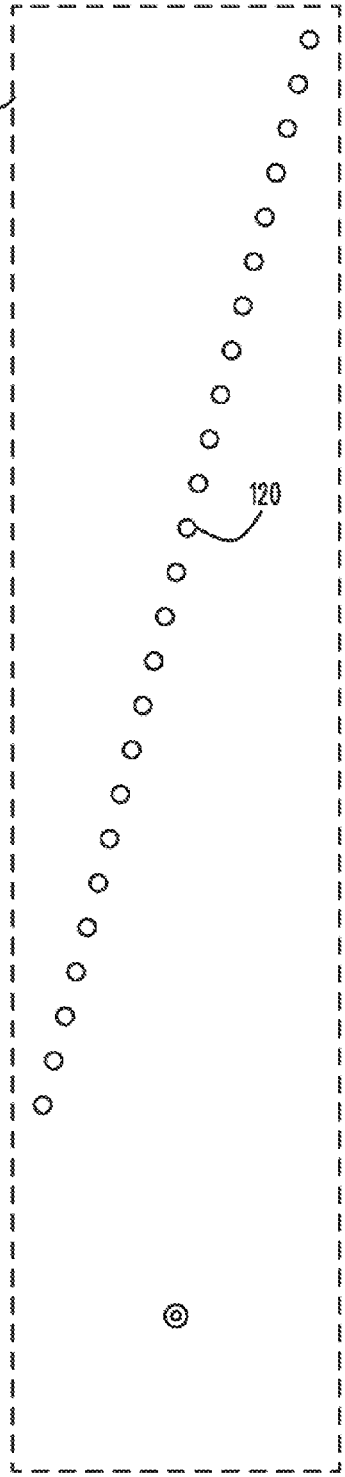
FIG. 9

VERTICALLY ARRANGED HAIR EXTENSION RACK

BACKGROUND OF THE INVENTIONS

1. Technical Field

The present inventions relate to hair racks and, more particularly, relate to racks for vertically arranging hair extensions.

2. Description of the Related Art

Hair extensions are used to add length, volume, highlights or lowlights to a person's own hair. They come in many different colors as well as many different lengths. Various methods are used from micro lining, bonding, braiding and clipping. Some hair is reusable and some hair can only be used once.

When a client came in for an adjustment and hair extensions needed to be removed from a client's hair, the hair needed to be organized so that it can be put back into the same location on the clients head. When a flat surface is used for storage, it caused the hair to get tangled and fall on the floor, causing loss of time and hair going into the wrong place on the clients head. The hair has been separated by paper of foil to separate the rows. Also used was a chart that is laminated and then double sided tape holds the hair on the flat surface to separate the rows. Each method that we currently use causes the hair falls on the floor of the salon which is a sanitation issue.

BRIEF DESCRIPTION OF THE DRAWINGS

The present inventions are illustrated by way of example and is not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein:

FIG. 6 illustrates a side view of a vertical support member with holes in a left hand spiral according to one embodiment of the present inventions;

FIG. 7 illustrates an exploded view of an unwrapped surface of the vertical support member with holes in a left hand spiral according to one embodiment of the present inventions;

FIG. 8 illustrates a side view of a vertical support member with holes in a right hand spiral according to one other embodiment of the present inventions;

FIG. 9 illustrates an exploded view of an unwrapped surface of the vertical support member with holes in a right hand spiral according to one other embodiment of the present inventions;

DETAILED DESCRIPTION OF THE PREFERRED EMBODIMENTS

Figure 1:
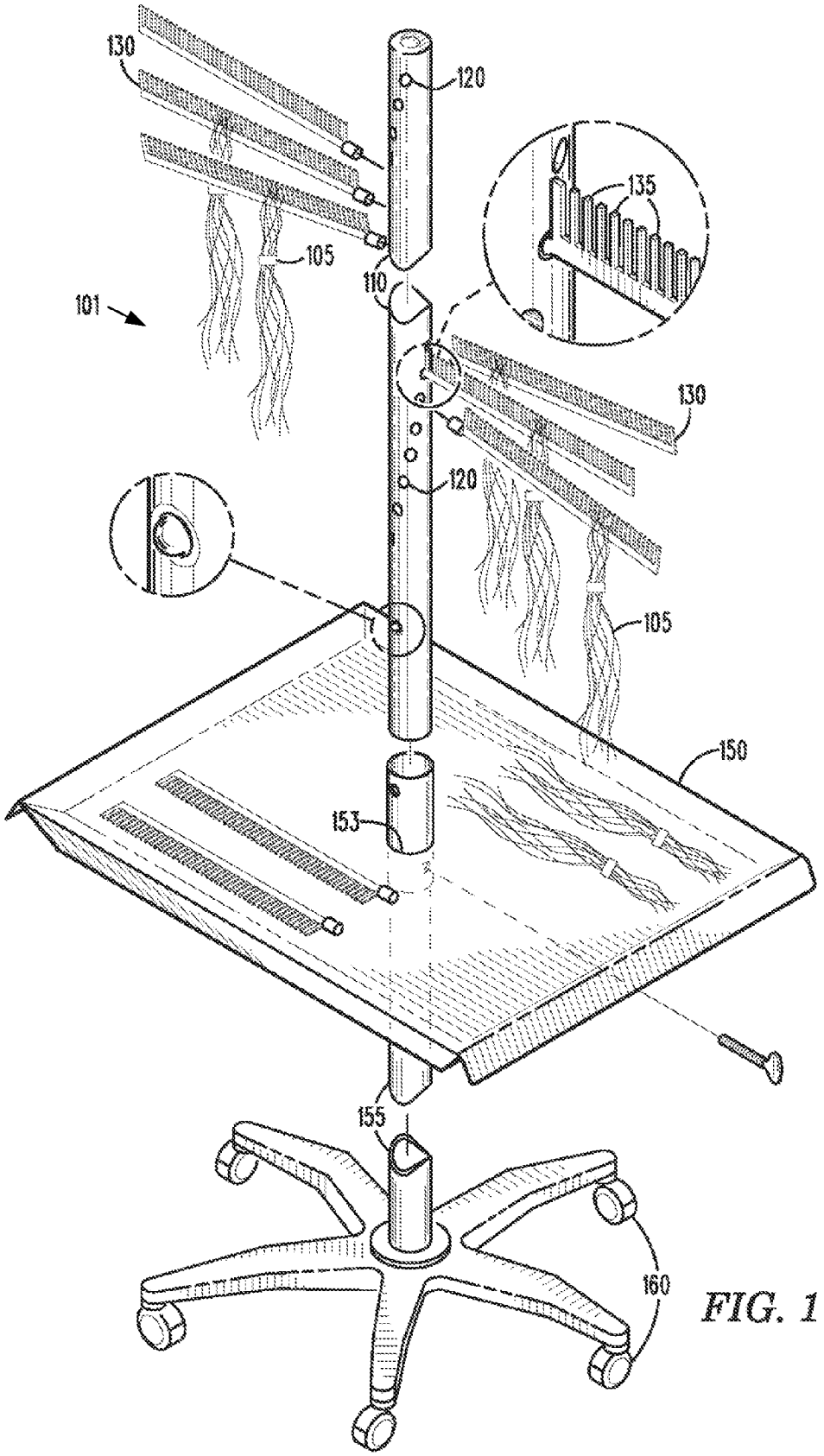
FIG. 1 illustrates a perspective view of the vertically arranged hair extension rack according to one embodiment of the present inventions.

FIG. 1 illustrates a perspective view of the vertically arranged hair extension rack according to one embodiment. A rack 101 holds hair extensions 105. A vertical member 110 has a series of openings 120 arranged along a length of the vertical member. Combs 130 attach to the vertical member 110 of the rack 101 in openings 120. Each of the combs 130 has a coupling surface capable of adaptively coupling with one of the plurality of openings 120 will be described in greater detail with respect to FIGS. 4 and 5. Each of the combs 130 preferably has a row of teeth 135 for holding one or more of the hair extensions 105.

The openings 120 in the vertical member 110 are diagonally arranged along a length of the vertical member in a pattern as illustrated in the one embodiment of FIG. 1. The openings in the vertical member are arranged in a spiral for an organization of hair extensions according to where they go on a head and adapt to right or left handed users or different styles and kinds of extensions on one or more heads.

The inventions are used to arrange and organize hair extensions in a vertical formation such as arranged in groups or a spiral arrangement. The hair extensions can be organized for the sequence of attaching or removal from the head. This way the hair extensions are kept in order so that they can go easily back into the head in the same location that they were removed. Combs can have a mark in the center so that the center of a row can be easily detected. It can also be used to assist in the blending and holding of synthetic hair extensions. Because the combs can be attached in different locations around the pole, the inventions are adaptable for either a right or left handed person and is useful for multiple rows of hair.

This invention creates an easy organized method of attaching and removing of micro linking extensions. Then after the service is done, they can go back in the same location that they came out of. When the extensions are put into the clients hair they are cut to blend in with the clients own hair. Because of this the extensions are different lengths in different location on the head, and it is important to keep them organized so that you can put them back into the general location on a client's hair. It also saves time by the extensions not getting tangled. The hairstylist can also wash, deep condition, color, perm, flat ironed or do a Keratin treatment to the hair while it is on the rack before going back into go into the clients hair. Some of these services are not recommended to be done while they are in the clients head, due to product getting into the cylinders that would cause slippage of the cylinders or damage to the clients own hair. The inventions are also used to help plan out the placement of all hair extension methods on the market.

Synthetic extension can also be added to a client's hair by braiding them in and then they are melted onto themselves. Since synthetic extension cannot be colored a stylist can mix multiple colors together to get the color that would match the clients own hair. Or the right color for a lowlight or highlight. This invention would be able to hold the multiple colors of the synthetic hair to keep them organized. Also by hanging the hair in a vertical spiral pattern you can see a blended result before mixing the colors together. Once they are mixed, it is very hard and time-consuming to unmix.

Alternative arrangements of the combs on the vertical member are permitted by the present inventions to facilitate different handedness and types of hair extensions or arrangements. The openings in the vertical member can alternately be arranged in other patterns as desired for an organization of hair extensions according to where they go on a head and adapt to right or left handed users or different styles and kinds of extensions on one or more heads.

The spiral or other patent can extend into a repeating pattern. Other alternative embodiments of patterns for the openings 120 along a length of the vertical member 110 will be described in greater detail with respect to FIGS. 6-15.

The rack for holding hair extensions according to the one embodiment illustrated in FIG. 1 has a table 150 with an opening 153 near a center to accept the vertical member 110 with the vertically arranged openings 120 above a surface of the table. A tubular member 155 is configured beneath the surface of the table and attached to casters 160 resting on the floor. The tubular member 155 has a larger or smaller diameter than a diameter of the vertical member 110 and is capable of slidably accepting the vertical member so as to store and hide the vertical member beneath the surface of the table when not in use. Telescoping into table so it is hidden is an alternative sliding. Drawers can be placed beneath a top of the table 150.

Figure 2:
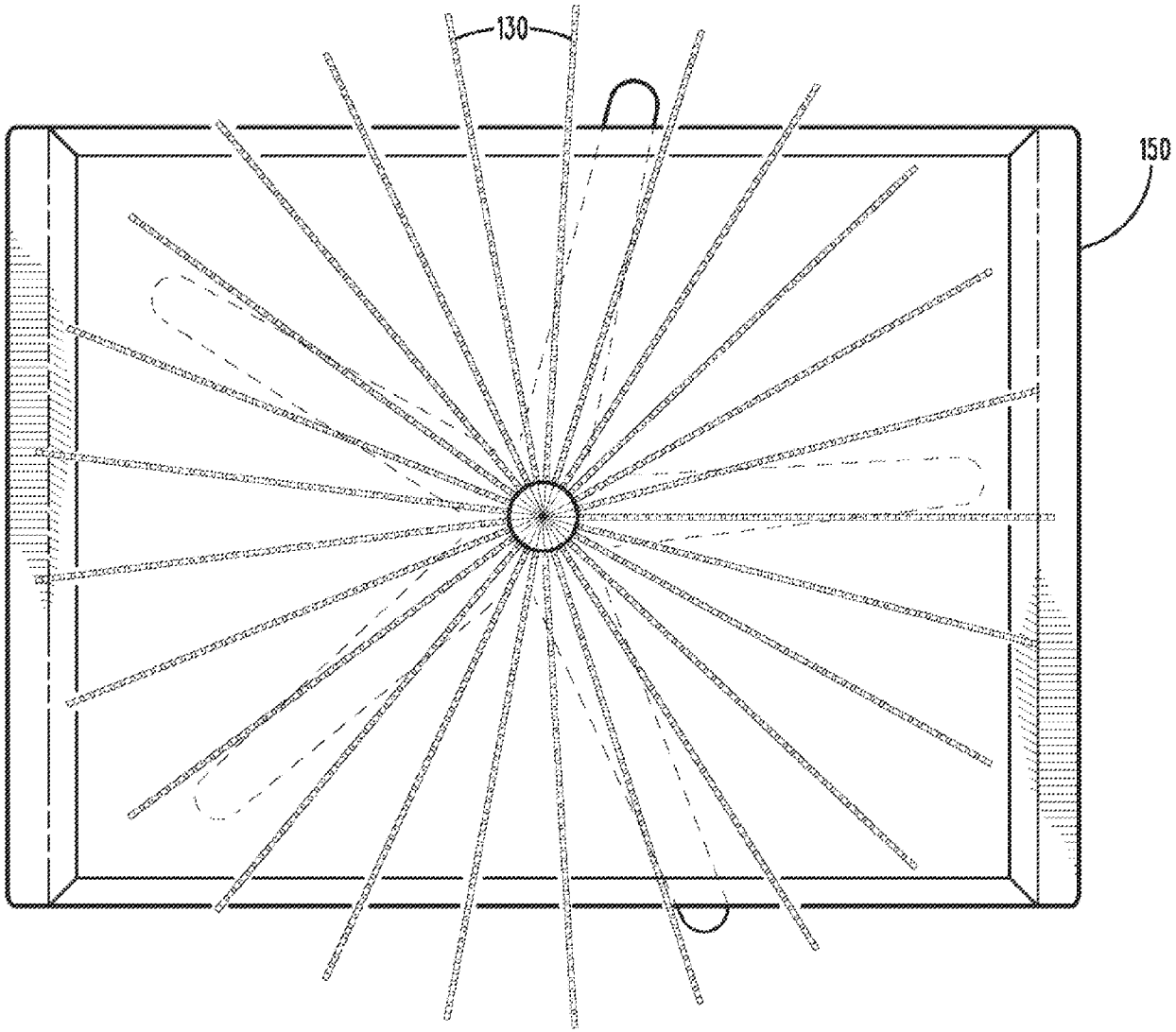
FIG. 2 illustrates a top view of the vertically arranged hair extension rack according to one embodiment of the present inventions.

FIG. 2 illustrates a top view of the vertically arranged hair extension rack according to one embodiment. In the embodiment of FIG. 2 the combs 130 face upwards away from the top of the table 150.

Figure 3:
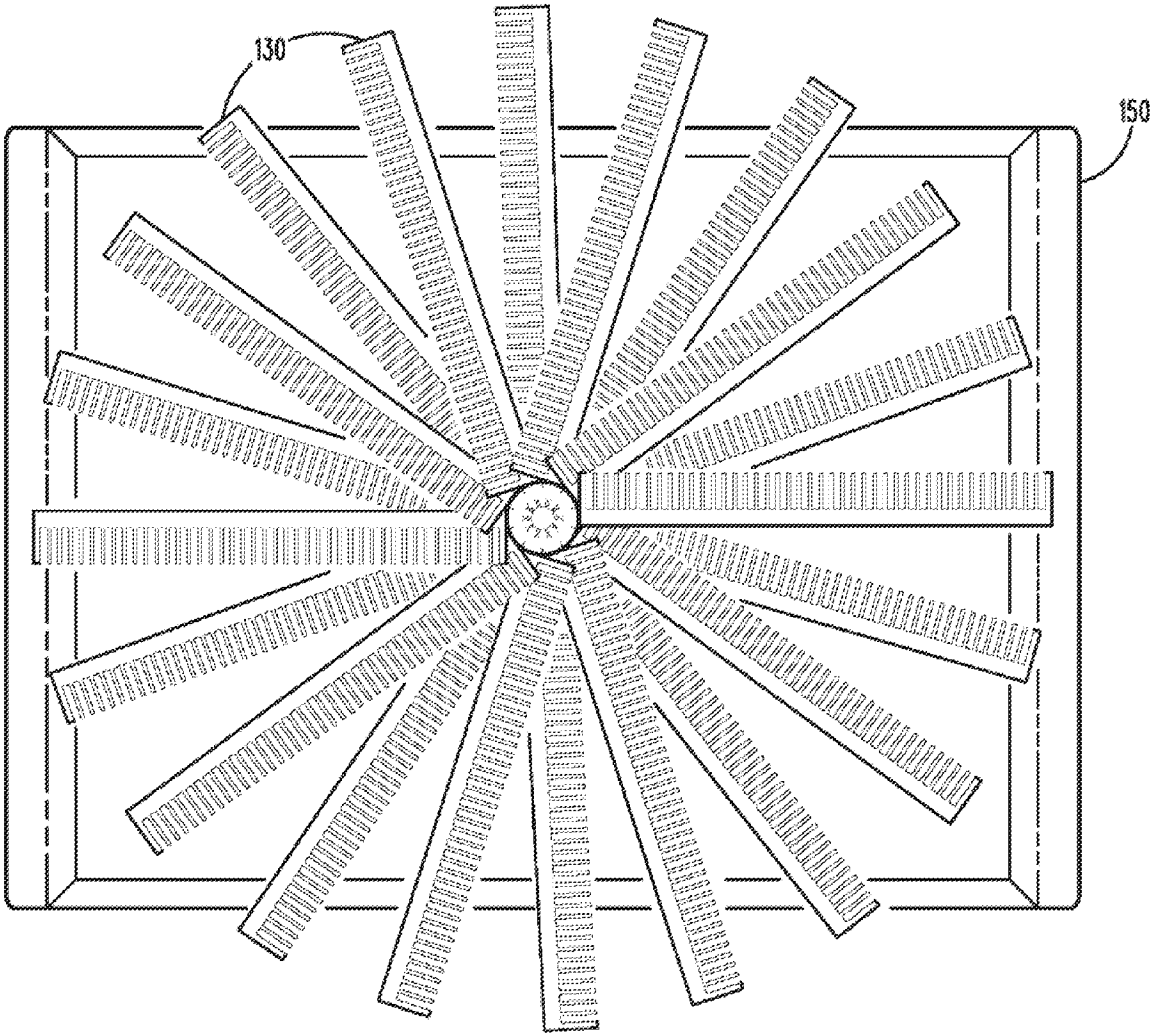
FIG. 3 illustrates a top view of the vertically arranged hair extension rack according to one other embodiment of the present inventions.

FIG. 3 illustrates a top view of the vertically arranged hair extension rack according to one other embodiment. In the embodiment of FIG. 3 the combs 130 face sideways. The combs 130 are also and are above the table 150. The illustration of the embodiment of FIG. 3 also nicely emphasizes the vertical spiral arrangement of the combs 130.

Figure 4:
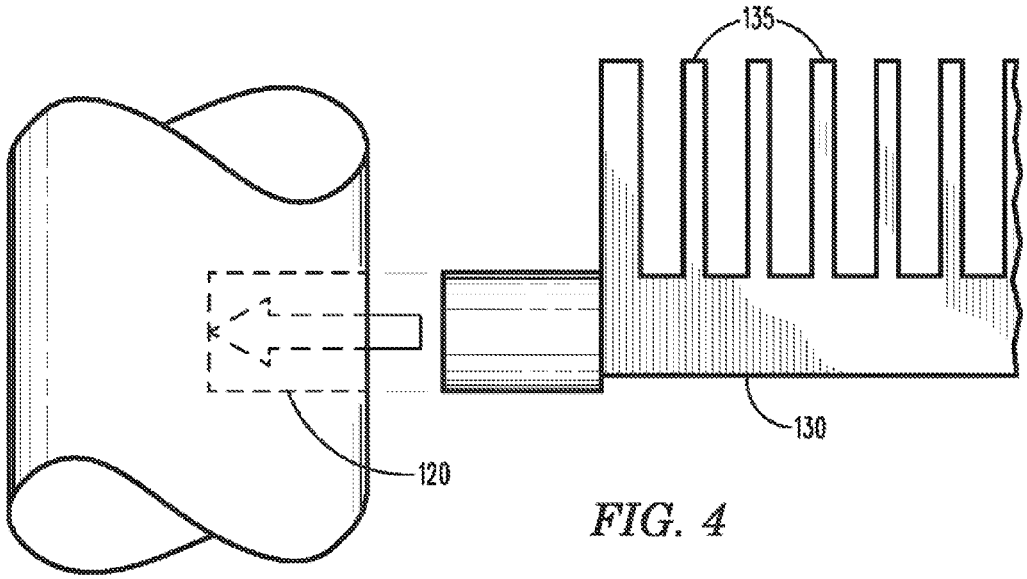
FIGS. 4 and 5 illustrate a close cutaway view of a comb attached to holes in a vertical support member according to one embodiment of the present inventions.
Figure 5:
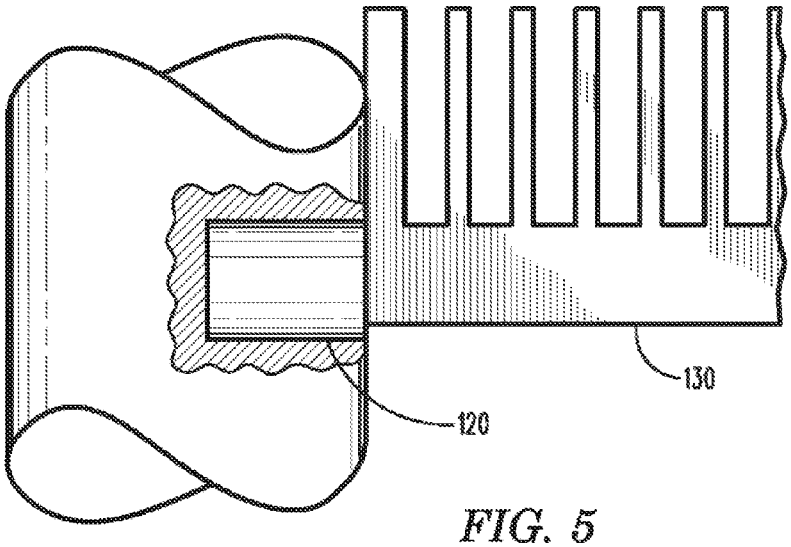

FIGS. 4 and 5 illustrate a close cutaway view of a comb attached to holes in a vertical support member according to one embodiment. FIG. 4 illustrates the comb 130 outside of an opening 120. The openings 120 are preferable holes drilled into a tubular metal vertical member 110. FIG. 5 illustrates the comb 130 secured inside the opening 120. Each of the combs 130 has a coupling surface capable of adaptively coupling with one of the plurality of openings 120 will be described in greater detail with respect to FIGS. 4 and 5. The coupling surface of each of the combs preferably comprises a metal cylindrical ring attached to an end of the comb 130 and adapted to couple with the opening 120 of the vertical member.

FIG. 6 illustrates a side view of a vertical support member with holes in a left hand spiral and FIG. 7 illustrates an exploded view of an unwrapped surface of the vertical support member with holes in a left hand spiral according to one embodiment. The rack holding hair extensions on combs in left handed pattern is adapted for a left handed user.

FIG. 8 illustrates a side view of a vertical support member with holes in a right hand spiral and FIG. 9 illustrates an exploded view of an unwrapped surface of the vertical support member with holes in a right hand spiral according to one other embodiment. The rack holding hair extensions on combs in right handed pattern is adapted for a left handed user.

Figures 10, 11:
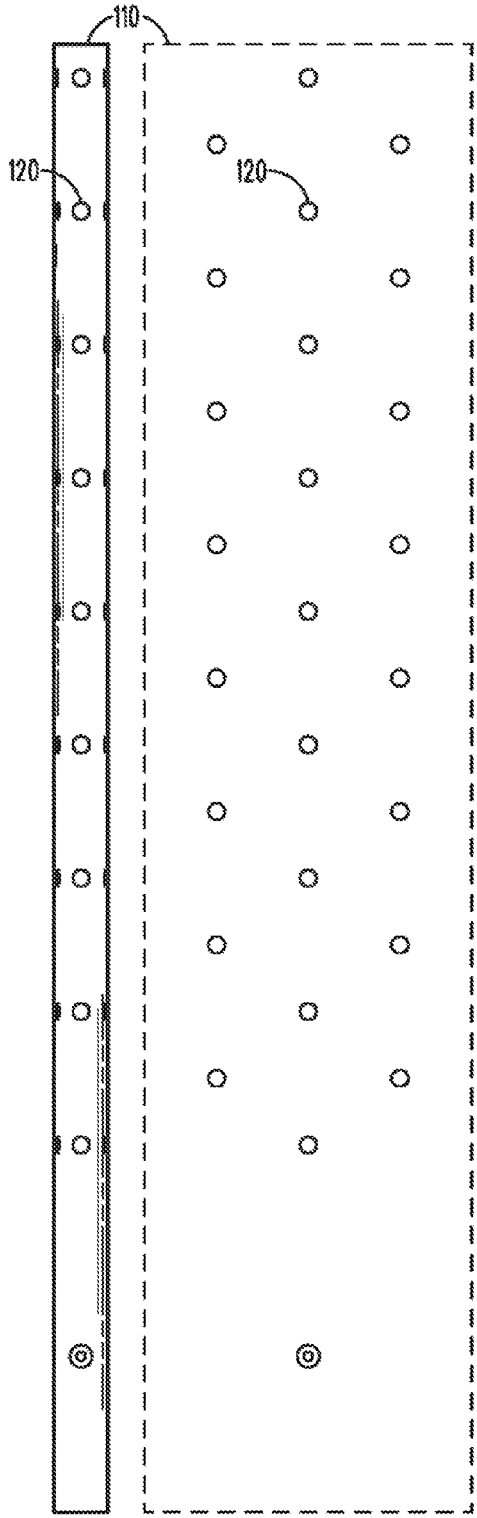
FIG. 10 illustrates a side view of a vertical support member with holes in a zig-zag according to one other embodiment of the present inventions.
FIG. 11 illustrates an exploded view of an unwrapped surface of the vertical support member with holes in a zig-zag according to one other embodiment of the present inventions.

FIG. 10 illustrates a side view of a vertical support member with holes in a zig-zag and FIG. 11 illustrates an exploded view of an unwrapped surface of the vertical support member with holes in a zig-zag according to one other embodiment. The rack holding hair extensions on combs in zig-zag pattern with both a right handed zigzag pattern and a left handed zigzag pattern adapted for both right and left handed users. Because a combined right and left pattern may be more difficult for a user to visually understand where to place combs, a sole left handed or a sole right handed zig-zag pattern can also be implemented even though it is less versatile.

Figures 12, 13:
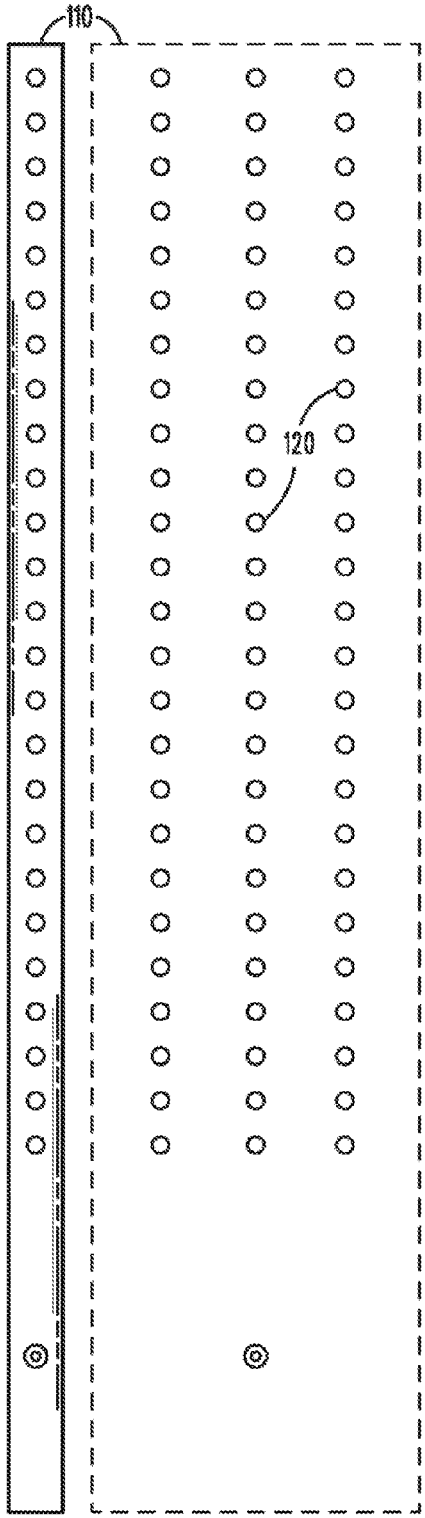
FIG. 12 illustrates a side view of a vertical support is member with a matrix of holes according to one other embodiment of the present inventions.
FIG. 13 illustrates an exploded view of an unwrapped surface of the vertical support member with the matrix of holes according to one other embodiment of the present inventions.

FIG. 12 illustrates a side view of a vertical support member with a matrix of holes and FIG. 13 illustrates an exploded view of an unwrapped surface of the vertical support member with the matrix of holes according to one other embodiment. The matrix of holes permits combs to be placed in varied locations and form different patterns such as many of those discussed herein and others. The matrix of holes is a series of vertical lines. In a further embodiment, rather than a matrix, one single line of vertical holes can be provided. While one single line of vertical holes has the disadvantage of hair extensions touching one another, if the combs have teeth extending in alternate directions or the combs are unconventional or bent, the single line of vertical holes arrangement is useful.

Figures 14, 15:
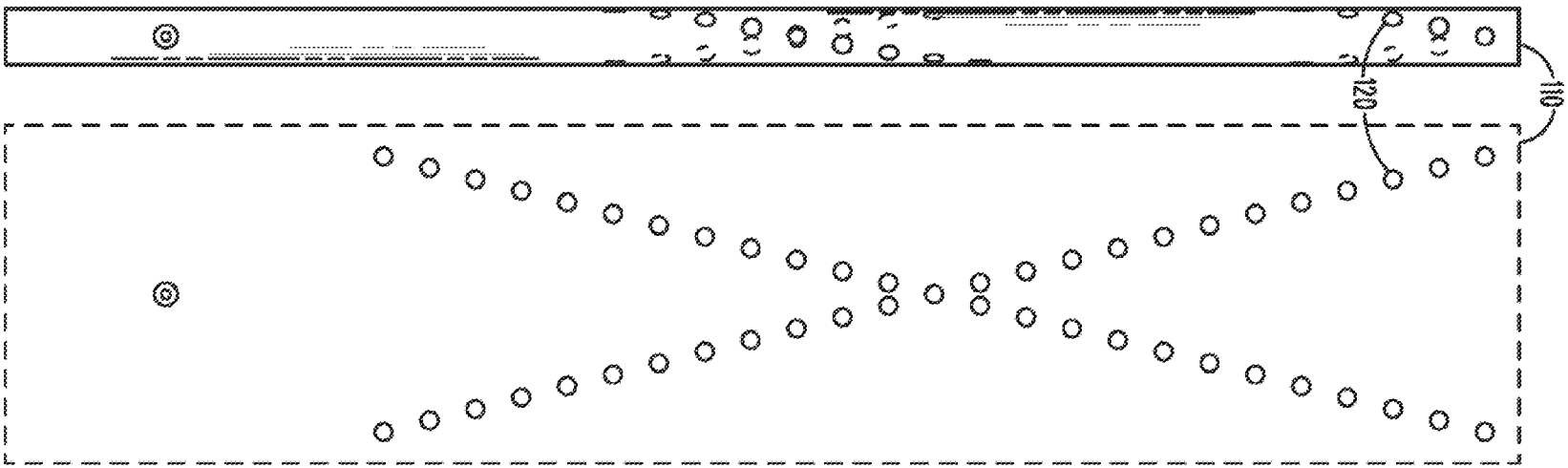
FIG. 14 illustrates a side view of a vertical support member with holes in both a right hand spiral and a left hand spiral according to one other embodiment of the present inventions.
FIG. 15 illustrates an exploded view of an unwrapped surface of the vertical support member with holes in both a right hand spiral and a left hand spiral according to one other embodiment of the present inventions.

FIG. 14 illustrates a side view of a vertical support member with holes in both a right hand spiral and a left hand spiral and FIG. 15 illustrates an exploded view of an unwrapped surface of the vertical support member with holes in both a right hand spiral and a left hand spiral according to one other embodiment adapted for respective right and left handed users.

Figure 16:
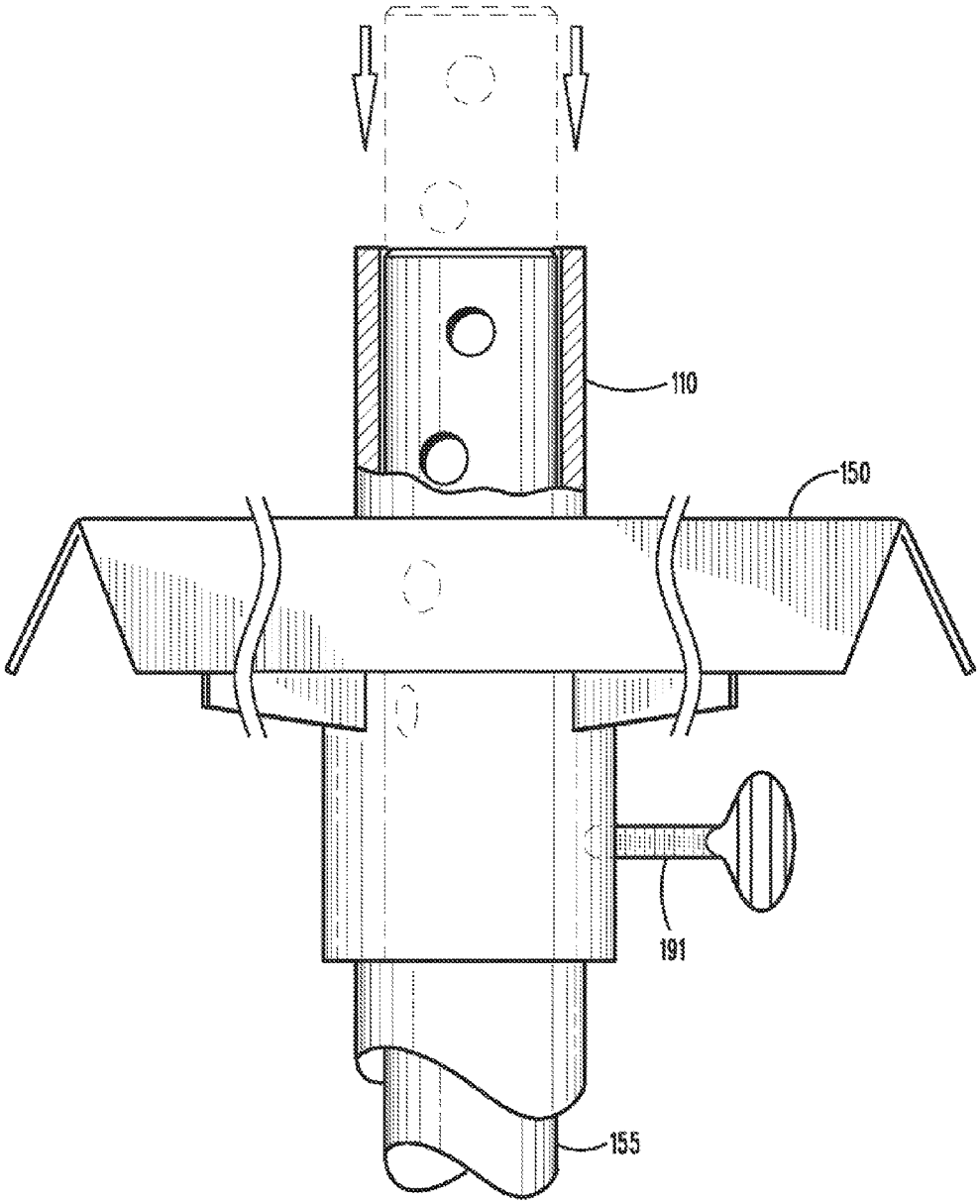
FIG. 16 illustrates a close cutaway view of the vertical support member in a storage position beneath a table surface according to one embodiment of the present inventions.

FIG. 16 illustrates a close cutaway view of the vertical support member in a storage position beneath a table surface according to one embodiment of the present inventions. A thumbscrew 191 secures the vertical member. In an alternate embodiment a single touch latch at the top of the vertical pole to extend it upwards when stored below the table top. To operate the single touch latch push it in and then it will pop out to a smaller pole so that you can use it as a handle and pull up the whole pole. When finished push the latch back down and it will sit flush to the top of the pole.

The combs can be arranged along the diagonal openings in the vertical member to hold hair extensions in groups organized according to their placement on a head. Examples groups are left side, right side and back of head. The groups can also be organized by hair color so that stylists can achieve a better pattern of highlight, lowlight or dimension.

The improvement is also useful for organizing hair extensions so they can be colored on the rack or permed on the rack. By organizing them in groups, it makes it easier for a hairstylist to make sure the extensions can be colored darker in the back for the nape of the head.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A rack for holding hair extensions, comprising:

a vertical member comprising a plurality of openings arranged along a length of the vertical member, wherein the plurality of openings in the vertical member are diagonally arranged along a length of the vertical member in a pattern;

a work surface attached to the vertical member along the length of the vertical member and beneath the plurality of openings; and a plurality of combs, each of the plurality of combs comprising a row of teeth for holding hair extensions and a coupling surface adaptively coupling with one of the plurality of openings, wherein each of the combs is placed in one of the plurality of openings to hang the hair extensions therefrom, and wherein each of the combs is placed in the one the plurality of openings no further down the vertical member than the work surface; and wherein both the coupling surface of each of the plurality of combs and the plurality of openings in the vertical member are adapted to selectively couple each comb to one of the openings in the vertical member at a user selective angle for each comb relative to the vertical member.

2. A rack for holding hair extensions according to claim 1, wherein the pattern comprises a spiral pattern.

3. A rack for holding hair extensions according to claim 1, wherein the pattern comprises a right handed pattern adapted for a right handed user.

4. A rack for holding hair extensions according to claim 1, wherein the pattern comprises a left handed pattern adapted for a left handed user.

5. A rack for holding hair extensions according to claim 1, wherein the pattern comprises both a right handed pattern and a left handed pattern, each adapted for respective right and left handed users.

6. A rack for holding hair extensions according to claim 5, wherein the right handed pattern comprises a spiral pattern; and wherein the left handed pattern comprises a spiral pattern.

7. A rack for holding hair extensions according to claim 1, wherein the pattern comprises both a right handed zigzag pattern and a left handed zigzag pattern adapted for both right and left handed users.

8. A rack for holding hair extensions according to claim 1, wherein the pattern comprises a repeating pattern.

9. A rack for holding hair extensions according to claim 1, wherein the pattern comprises a zigzag pattern.

10. A rack for holding hair extensions according to claim 1, wherein the work surface comprises a table coupled to the vertical member and comprising an opening near a center to accept the vertical member.

11. A rack for holding hair extensions according to claim 10, further comprising a tubular member configured beneath the surface of the table and capable of slidably accepting the vertical member so as to selectably hide the vertical member beneath the surface of the table.

12. A rack for holding hair extensions according to claim 1, wherein each of the combs further comprises a cylindrical ring on the coupling surface of the comb adapted to couple with one of the openings of the vertical member; and wherein each of the openings comprise a hole in the vertical member to accommodate one of the combs at the user selective angle of rotation for each comb.

13. A rack for holding hair extensions according to claim 1, wherein each of the combs is removably placed in a selective one of the plurality of openings to hang the hair extensions therefrom spread out both vertically and horizontally from one another.

* * * * *